United States Patent [19]

Harvey

[11] Patent Number: 4,968,396

[45] Date of Patent: Nov. 6, 1990

[54] METHOD OF AND ELECTROLYTIC-CATALYTIC CELL FOR IMPROVING THE COMPLETION OF COMBUSTION OF OXYGENATED HYDROCARBON FUELS BY CHEMICALLY MODIFYING THE STRUCTURE AND COMBUSTIBILITY THEREOF, INCLUDING THROUGH DEVELOPING HYDROXYL IONS THEREIN

[75] Inventor: Draper M. Harvey, Hingham, Mass.

[73] Assignees: The Academy of Applied Science; Rines and Rines, both of Concord, N.H. ; a part interest

[21] Appl. No.: 304,187

[22] Filed: Jan. 30, 1989

[51] Int. Cl.[5] ..... C25F 5/00

[52] U.S. Cl. ..... 204/131; 204/222; 204/242; 204/272; 204/280; 204/292; 429/17; 429/27; 429/68

[58] Field of Search ..... 429/17, 27, 68; 204/101, 130, 131, 242, 272, 280, 292, 222; 123/538

[56] References Cited

U.S. PATENT DOCUMENTS

| | | | |
|---|---|---|---|
| 2,469,680 | 5/1949 | Butler | 204/248 |
| 4,373,494 | 2/1983 | McMahon | 123/538 |

*Primary Examiner*—John F. Niebling
*Assistant Examiner*—Kathryn Gorgos
*Attorney, Agent, or Firm*—Rines and Rines, Shapiro and Shapiro

[57] ABSTRACT

A method and electrolytic catalytic cell that chemically modifies the structure of hydrocarbon fuels in which the cell is immersed, by the electrolytic, electromotive catalytic action of preferably platinum cathodic and zinc anodic elements movably continually contacting and circulating the fuel, giving rise to evenness in ignition and completion of combustion with elimination of noxious by-products largely by combination with the hydroxyl ions formed by the catalytic action.

27 Claims, 1 Drawing Sheet

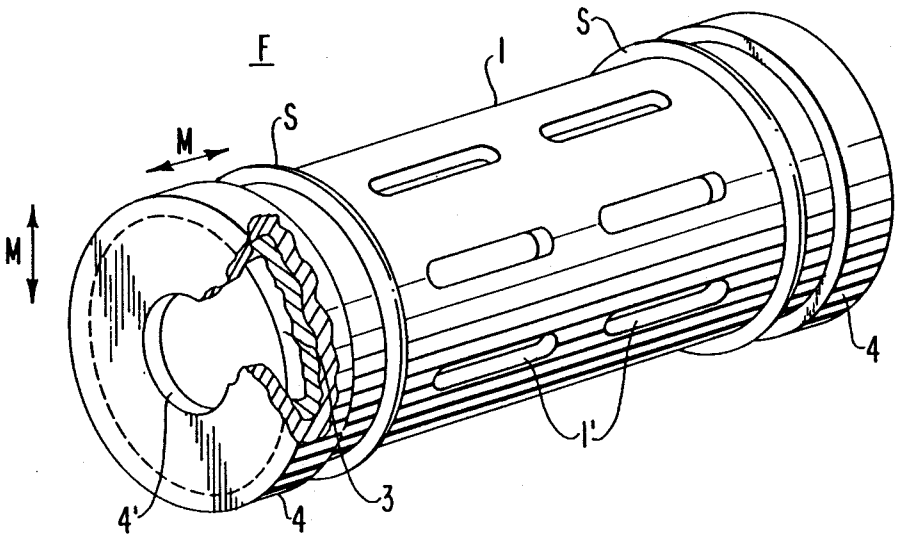
F
S
S
1
1'
4
4
3
4'
M
M

METHOD OF AND ELECTROLYTIC-CATALYTIC CELL FOR IMPROVING THE COMPLETION OF COMBUSTION OF OXYGENATED HYDROCARBON FUELS BY CHEMICALLY MODIFYING THE STRUCTURE AND COMBUSTIBILITY THEREOF, INCLUDING THROUGH DEVELOPING HYDROXYL IONS THEREIN

BACKGROUND OF THE INVENTION

The present invention relates to methods of and catalytic cells for improving the totality and progression of completion of combustion of oxygenated hydrocarbon fuels, being more particularly directed to pre-combustion catalytic treatment of and chemical hydrocarbon change in the fuel, including the development of hydroxyl ions, that, upon combustion, causes the fuel to propagate ignition evenly through the entire combustion process within any internal combustion mechanism, substantially eliminating noxious by-products. More generically, the invention relates to elimination of such undesired by-products of hydrocarbon combustion and the like through the development of hydroxyl ions that during and following combustion have been found to scavenge or remove such by-products—such being applicable to other hydrocarbon burning or consumption systems than internal combustion engines, as well.

The invention is designed more specifically, in preferred, though not exclusive, application, for the principal purpose of providing for improved combustion characteristics of gasoline as an internal engine fuel with benefits that include (a) improved startability under adverse ambient conditions; (b) decrease in the formation of noxious and contaminating elements as contained normally within the exhausted products of combustion as these enter the atmosphere, including carbon monoxide, hydrocarbon particulates, nitrogen oxide and other exhausted products, some of which are carcinogenic when aspirated or when such products come in contact with skin surfaces of humans; (c) to provide for an extended service life of catalytic converters as used on automotive vehicles; and (d) to result in a decreased requirement of gasoline as an engine fuel as a product of more complete combustion with extrapolated development of useful energy in excess of the normal combustion characteristics of this engine fuel, a supporting reference to which is evident by an elimination or reduction of combustion by-products, including carbon monoxide, HC particulates and nitrogen oxide.

The application of this invention, either as an original equipment accessory or as a retro-fit product, is with positive benefit to environmental conditions at any gridlock locus of vehicle emissions contamination since noxious products of emissions are transported by air currents for great distances. Such emission products, entrained within the atmosphere, combine with moisture within the atmosphere to form super-acid precipitation, subsequently to the displacement of carbon dioxide in natural precipitation. The adverse influence of such super-acid precipitation on terrestrial and aquatic life forms and on the potability of ground water resources is recognized as an ongoing and expanding environmental hazard. Since noxious emissions from vehicles represent in excess of forty percent (40%) of atmospheric pollutants, the application of this method of emission control or elimination is a technology with merit in the suppression of environmental hazards, including acid rain and ozone contamination.

The art is replete with techniques for catalytically (and otherwise) aiding the combustion of oxygenated hydrocarbon fuels. Among such is the application of minute trace particles of platinum in hydrocarbon fuels preliminary to combustion, hopefully to improve completeness of the combustion, or to introduce a bubble of air containing platinum traces for mixture with the fuel within the entering air stream. The lack of efficacy of such methods is demonstrated by the mandated application of two and three stage catalytic converter systems which by design are intended to induce combustion of emission by-products within an after-burner device and before emission products enter the atmosphere.

Underlying the present invention is the discovery that immersion of the catalytic element in the fuel within the fuel tank provides for a continued surface contact of an anode of zinc and a cathode of partly platinum and partly rhodium to provide for a catalytic response in the fuel by means of electrolysis. The pre-combustion catalytic response effected by the anodic and cathodic electromotive action in the electrolytic fuel is of such a nature as to modify or alter the structure of the hydrocarbon fuel, generating hydroxyl ions and hydrogen oxides within the fuel, the former having been found effectively to scavenge or substantially eliminate the above-described and other undesired combustion by-products. The minimal requirement of the ionization of the noble metals as required for effective catalyzation of the hydrocarbon fuel is affirmed by the extended efficacious use of the invention as a catalyst within the fuel supply of a vehicle for a period of three or more years of normal vehicle operation.

With the use of this invention and subsequently to the catalytic response of the fuel, a phenomenon which is prompt and sustained, it has been found that the modified fuel ignites promptly with even propagation of the combustion flame front during the entire combustion process. When the altered fuel is consumed, it has been found that hydrogen oxides within the fuel mixture act beneficially and in the manner of tetraethyl lead (TEL) and other prior fuel additives to reduce octane requirements and at the same time that the hazards associated with the use of TEL are eliminated. The hydrogen oxides, pre-developed in the fuel by catalytic action, serve as effective carriers of primary oil lubricants to result in reduced wear factors of reciprocating and rotating engine components. The rhodium (and/or rhenium) influence on the combustion process results in a reduction of combustion temperatures to minimize or eliminate the production of oxides of nitrogen during the combustion process.

SUMMARY OF THE INVENTION

An object of the present invention, accordingly, is to take advantage of the above-described discovery in providing a new and improved method of and catalytic cell for improving the completion of combustion characteristics of oxygenated hydrocarbon fuels through catalytic and electrolytic pre-treatment of the fuel.

An additional object of the invention is to provide a novel method of entraining hydroxyl ions within the hydrocarbon fuel (pre-combustion) that have been found materially to contribute to the scavenging or substantial eliminating of the noxious by-products of combustion during and post combustion; and more generically, to the making available of such hydroxyl ions for the combustion and/or post combustion stages in order to effect such scavenging.

A further object is to provide a novel fuel-modifying catalytic cell that provides for a catalytic response in the fuel supply of gasoline when the element is immersed in the gasoline with an electrolytic response developed by the exposure of the fuel to the dissimilar metals, preferably zinc or other similar negative metal as the anodic element and platinum, rhodium, rhenium and similar metals (i.e., platinum family) as the cathodic element.

While electrolytic cells have been used as water correction devices (Butler U.S. Pat. No. 2,469,680, for example), and to a limited extent in hydrocarbon products, such devices have not heretofore been effective for catalytic response in the pre-treatment of gasoline as an engine fuel.

This invention has been designed and constructed to obviate the limitations and failures of earlier catalytic or electrolytic devices and to provide for low cost manufacture, extended service life of up to several years in automotive fuel applications and maximum exposure of the engine fuel to the catalytic influences of the appropriate metals as employed in the fabrication and assembly of the catalytic cell. The invention also may be applied to bulk storage tanks of gasoline and other hydrocarbon fluids with motion imposed on the catalytic cell(s) in order to accomplish cost effective and beneficial results. As a practical solution to the expanding problems associated with atmospheric pollutions from combustion emissions, it is important that this invention can be applied to the estimated eighty percent of road vehicles which fail to meet present clean air standards as determined by the use of appropriate and approved evaluation equipment as made use of during intervals of vehicle inspection rather than by prescription of universal application when product usage is not indicated or required.

Other and further objects will be discussed hereinafter, being more particularly delineated in the appended claims.

In summary, however, from one of its viewpoints, the invention embraces a method of improving the progression and totality of combustion of oxygenated hydrocarbon fuels that leads to the substantial reduction or elimination of noxious emission by-products, that comprises, immersing within the fuel prior to combustion juxtaposed zinc and platinum (and rhodium or rhenium) surfaces; during such flowing, relatively moving the zinc and the platinum surfaces to provide for continual contacting therewith continually generating electropotentials and catalytically converting oxygen in the fuel to hydroxyl ions and hydrogen oxides which, on combustion with the atmosphere, cause the fuel to propagate ignition evenly through the entire combusion process while effecting a reduction or elimination of noxious emissions including by conversion, absorption and/or scavenging of the elements by the hydroxyl ions that would otherwise form the undesired by-products of incomplete combustion.

The utility of the invention can be measured effectively by equipment as used in the established practice of testing the degree of efficiency of any catalytic converter system and the composition of exhausted products of the combustion of hydrocarbon fuel in any internal combustion engine. With and without catalytic systems in place and in certain cases with the useful purpose of a catalytic converter system reduced to a point where compliance with defined standards, as imposed by the Environmental Protection Agency (EPA) of the Federal Government and certain states, is impaired and inoperative, the introduction of the catalytic cell of the invention will result in an effective modification of the burning characteristics of the gasoline to a degree where the test measurements will define the exhaust as having substantially zero carbon monoxide (CO) and zero hydrocarbon particulates (HC). A measurable increase in the production of carbon dioxide ($CO_2$) provides confirmation of the modified chemistry of the exhausted elements and in volume of complete compatibility with parameters of EPA requirements.

BRIEF DESCRIPTION OF THE DRAWING

A preferred construction of the catalytic cell, as provided for in this invention, for practicing the method thereof, is illustrated in the single side elevational figure of the drawing, partly broken away to show the internal construction. The internal anodic element of the invention is of a dimension that will result in the continual reciprocating movement of that element to provide for the induction of the fuel constantly to the multi-metal surfaces of the catalytic cell.

DETAILED DESCRIPTION OF THE PREFERRED EMBODIMENTS

Referring to the drawing, a perforated brass or bronze cylindrical tubular housing, plated for catalytic purposes with platinum on its exterior and interior surfaces is shown at 1, the perforations being illustrated as slots 1', preferably circumferentially symmetrically disposed about the cylinder, to permit the entry and exit of fuel F in which the cell is immersed. The cathode tube 1 (effectively "platinum" inside and out) has removable end caps 4, also perforated at 4' to permit the flow of the fuel, and preferably provided with rhodium or rhenium plating, inside and out.

The cathodic cylindrical tubular housing 1 contains an anodic similarly cylindrical rod member 3 of pure zinc, with the length and cross-sectional dimensions of the anodic rod member slightly less than the inner length of the housing 1 between the end caps 4 and the inner diameter of the housing, respectively, such as to provide for slight clearance and for the free or induced flow of fuel along all surfaces of the catalytic cell. As operated, with the fuel flowing and the anode rod 3 continually reciprocatingly moving, engaging and contacting the opposed inner walls of the cathode housing 1 and its end caps 4, juxtaposed and continual intimate contact of the anode rod surfaces and the cathode inner surfaces of the invention is achieved during the entire service life of the device, continually generating and surprisingly evenly distributing the hydroxyl ions and hydrogen oxides throughout the fuel. While the preferred form of the anodic (negative) element is as a solid rod of pure zinc, there may be substituted pellets or other shapes as dictated by the convenience of manufacture, assembly and required exposure to the fluid environment within which the metal is to be operative.

Electrically insulating O-rings or bumper washers of a composition suitable to prolonged exposure to hydrocarbon fuels are provided at spaced points at S along the external cylindrical body of the cell 1 to prevent electrical contact of the cell with the fuel container on a constant basis since the long dimension of the cell will be the resting direction. The end caps of the element, shorter than the cylinder 1 and rod 3, are plated either with rhodium or rhenium and are installed permanently to the tubular portion of the cell. The insulation of the element from the surface of the fuel tank, except infrequently, permits the electromotive reaction of the zinc element 3 and the inner platinum surface of the cathodic tube 1 and the inner rhodium surfaces of the end caps 4 as the hydrocarbon fuel flows therebetween during the movement of the vehicle. In addition, the back-and-forth or reciprocating inside motion (M) of the zinc anode 3 within the cylinder, which is continual during movement of the vehicle, provides a measure of piston-like action that induces and circulates a continuous flow of the fuel into and over the opposed surfaces of the elements, insuring uniform fuel treatment and enabling uniform catalytic reaction. This gives rise to the before-described well-distributed hydroxyl ion and stabilized hydrogen oxide pre-combustion modification of the fuel that has been discovered to adapt it for the novel progressive ignition and substantially complete combustion results previously described, also eliminating noxious exhaust products, including the deleterious precursors of ozone, acid rain and carcinogens, among them carbon monoxide, hydrocarbon particulates, nitrogen oxides, sulphur oxides, ozone, methane, etc.

The metallurgy of the invention makes use of metals such as platinum, rhodium and rhenium, all of which have the capacity to act as catalysts on hydrocarbon fuels when energized by a device with an electrolytic potential—in this case by means of intimate and continual electrolytic and direct contact of anodic and cathodic surfaces. The invention, moreover, provides for the containment of the anodic element in a form that assures exposure of the anodic metal to the fluid environment within which it is placed in operation and with maximum exposure of the fluid environment to the catalytic influence of the cathodic surfaces (platinum and rhodium or rhenium) and in such form that the reaction is sustained for an extended period with contact existing between portions of the prescribed metal surfaces at all times and with a surprisingly uniform distribution of moving hydroxyl ions or radicals throughout the fuel supply. The catalytic cell is a low-cost and cost-beneficial appliance for use in automotive vehicles, boats and other equipment of that nature with substantial benefit to environmental and ecological conditions and with an over-compensating reduction in fuel consumption by such equipment as the product is used.

Successful operation has been obtained in automotive vehicles when the fuel tanks of such vehicles have been equipped by immersion of one or more of such catalytic cells as the volume of contained fuel would dictate. A typical catalytic cell so used had an overall length of one and one-half inches and a circumference of one-half inch at the tubular portion of the element 1. The multiple slot perforations (eight pairs distributed symmetrically about the cell cylinder) were each one-eighth inch wide and a half inch long. A rod 3 of pure zinc with clearance of +0.0075 inch from the cathode cylinder inner walls was employed for a fuel supply tank with a capacity of less than twenty gallons, with successful operation in the described manner. When the fuel supply tank has a capacity in excess of twenty gallons, the use of two catalytic fuel cells is prescribed with an additional catalytic cell to be placed in use as the fluid volume is increased by increments of twenty gallons contained within the fuel supply tank. By extrapolation, an adequate decrease or increase in the required size of the element can be defined and fixed, but for general application, as required in the foreign and domestic population of automotive vehicles, it has been determined that a cell of the indicated dimensions is adequate and useful.

The following Table 1 demonstrates the efficacy of the invention. These data were developed by the use of EPA-approved emission evaluation test equipment after the installation and use of either one or two catalytic cells, with installation made after these vehicles, with moderate and extended mileage, had failed to meet acceptable EPA-mandated emission parameters. In such cases, the normal procedure, dictated by EPA and state regulations, would require that operational privileges for an offending vehicle be withheld until replacement had been made of an inoperative catalytic converter system or other repairs. The efficient service life of these and several hundred other vehicles was validated by EPA-type testing annually and the indicated compliance with EPA operational standards for each vehicle.

TABLE 1

ELECTROLYTIC & CATALYTIC FUEL CELLS
Performance Data + − Compliance With Emission Standards of EPA

| Test #2441332 | Test #0386103 | Test #1314629 | Test #0518072 |
|---|---|---|---|
| LOC #1086 | LOC #1127 | LOC #1491 | INSP STATION No. 1705 |
| Sep. 19, 1985 | Jan. 24, 1986 | May 23, 1985 | May 22, 1985 - Time - 11:54 AM |
| INSP #8407 | INSP #7808 | INSP #12080 | INSP #9500 |
| TEST TYPE I | TEST TYPE I | TEST TYPE I | TEST TYPE - I |
| VEH MAKE | VEH MAKE | VEH MAKE | VEH MAKE - Ford - 83 |
| OLDS M | CHEV | FORD | MILEAGE (000's) - 38 |
| VEH YR 82 | VEH YR 79 | VEH YR 82 | LIC NO. - 320 KFO |
| ODOM 090638 | ODOM 039059 | ODOM 077000 | ENG CYL - 8 |
| LIC PLATE | LIC PLATE | LIC PLATE | FUEL TYPE - GAS |
| 539 HUM | 941 GEO | HE74979 | VEH TYPE - PASS CAR |
| FUEL G | FUEL G | FUEL G | CATALYTIC CONVERTER - PRESENT |
| # CYL 8 | # CYL 8 | # CYL 8 | FILLER RESTRICTOR - PRESENT |
| VEH TYPE A | VEH TYPE A | VEH TYPE B | HC SPEC 220 TEST 0 PASS |
| HC 14 PPM | HC 57 PPM | HC 1 PPM | CO SPEC 1.20 TEST .00 PASS |
| LIMIT 220 | LIMIT 400 | LIMIT 220 | |
| CO 0.00% | CO 0.03% | CO 0.00% | CO2 SPEC 4.0 TEST 9.5 OK |
| LIMIT 1.20 | LIMIT 4.00 | LIMIT 1.20 | RPM SPEC 1200 TEST 1034 OK |
| PASS HC | PASS HC | PASS HC | TEST RESULT - PASS |
| PASS CO | PASS CO | PASS CO | |
| VALID CO2 | VALID CO2 | VALID CO@ | SAFETY REPORT - ALL PASS |
| VALID RPM | VALID RPM | VALID RPM | |
| SAFETY FAIL | SAFETY FAIL | SAFETY FAIL | INSPECTION STICKER NO. |
| NONE | NONE | NONE | 0518072 |
| STICKER NO. | STICKER NO. | STICKER NO. | |

TABLE 1-continued

| ELECTROLYTIC & CATALYTIC FUEL CELLS Performance Data + – Compliance With Emission Standards of EPA | | | |
|---|---|---|---|
| Test #2441332 | Test #0386103 | Test #1314629 | Test #0518072 |
| 2441332 | 0386103 | 1314629 | |

NOTES:
These data are reported as duplicates of official print-outs of computer analyses of these vehicles in compliance with emission standards as defined by the Environmental Protection Agency and the Commonwealth of Massachusetts. The emissions test equipment was of a type approved for that purpose by the Environmental Protection Agency and each test was initiated and completed at an Inspection Test Station as approved by the Commonwealth of Massachusetts. Tests Nos. 2441332, 0386103 and 1314629 were made after these vehicles had been tested and failed an original emission evaluation. A catalytic fuel cell was placed in the fuel supply tank of each vehicle and each vehicle was operated for fifty miles. A second test was initiated at that point and results are as indicated above. Each vehicle continues to function in compliance with EPA standards. These data are references developed by such acceptable procedures for approximately 500 vehicles.

A determination of the quantity of hydroxyl ions or radicals, necessary or sufficient to cause the effective combining, conversion, absorption and/or scavenging of the fuel elements by the hydroxyl ions or radicals, which elements would otherwise have formed the noxious by-products in normal combustion, may be empirically arrived at for each fuel supply system—first, by observing the uniformity and distribution of the Brownian-movement of the hydroxyl ions or radicals throughout a sample of the fuel and which it has been found should be well-distributed for effective operation; and secondly, by measuring the level of by-product still in the exhaust, and increasing the hydroxyl ion generation to minimize or eliminate the same, as desired. As a guideline, in a twenty gallon gasoline tank for an automobile, a single cylindrical catalytic electromotive or electropotential cell of the one and one-half inch by half-inch diameter dimensions before described, subjected to normal vehicular movements, has been found to generate sufficient hydroxyl ions distributed sufficiently uniformly and continually throughout the fuel to provide the successful degree of noxious by-product elimination in Table 1.

While the invention has been mainly described for the illustrative example of hydrocarbon fuel combustion in internal combustion engines, it is believed that the broad discovery underlying the invention of the scavenging effect of well or evenly distributed hydroxyl ions during combustion is more widely applicable in other kinds of hydrocarbon burning or combustion systems, as well, including those where the hydroxyl ions may be made available during and/or post combustion to effect the hydroxyl radical combination, converting, absorbing or scavenging of the elements that would otherwise form the noxious by-products. Electrolytic cell generators of the type described herein, appropriately configured, may be used, for example, with auxilliary fuel supplies to inject hydroxyl ions into other types of combustion processes and stacks, and other techniques including chemical generation of the hydroxyl ions may also be employed.

In connection with the value of hydroxyl radicals as scavengers of gasses that are common as by-products of the combustion process within internal combustion engines, it appears that such operation is of value for that same purpose irrespective of the particular mechanics of the combustion process as, for example, within furnaces, oil burners, power plants, smelters, steel mills, etc., and regardless of the nature of the hydrocarbon fuel employed to produce combustion. The significant consideration is that any combustion process produces gaseous residues as emission products and hydroxyl ions have been found to have a capacity to scavenge or assimilate such products. In this process, emissions from all forms of combustion could be reduced or eliminated either during or after the combustion cycle by the introduction of hydroxyl ions into the ambient atmosphere that supports the combustion process. The simple structure of hydrogen (one electron and one proton) permits separation by an electrolytic or catalytic process to result in the structuring of hydrogen ion (which is in fact the remaining proton) and, in the presence of oxygen, becomes hydroxyl ion or radical. A most important consideration is that scavenging does occur when several by-products of hydrocarbon combustion are exposed to hydroxyl radicals such as is evident in the scavenging of carbon monoxide, nitrogen oxides and other residues that develop from the production of hydroxyl ions within gasoline that has been exposed to the composite influence of the catalytic fuel cell of the present invention.

Further modifications will also occur to those skilled in this art such as, for example, the use of other negative anodic metals in pellet form, with which pellets of rhenium might be mixed to provide for beneficial operation of the cell when certain gasoline fuel blends might be placed in selective service. Other modifications might include alteration of the geometric shapes of the cells or of the interdependent components of the catalytic element; particular sizes and shapes as may be dictated by vehicle modifications either for retro-fit or original equipment applications and other variants; other cell-element moving mechanisms than the motion-induced reciprocation of the anode rod within the housing; all such being considered to fall within the spirit and scope of the invention as defined in the appended claims.

What is claimed is:

1. A method of improving the progression and totality of combustion of oxygenated hydrocarbon fuel that leads to the substantial elimination of noxious emission by-products, comprising immersing within the fuel prior to combustion an electrolytic cell comprising juxtaposed zinc and platinum electrode surfaces to generate electropotentials; flowing the fuel along said surfaces; during such flowing, relatively moving the zinc and the platinum electrode surfaces to provide for continual contacting with the fuel to continually generate electropotentials and catalytically convert the oxygen in the fuel to hydroxyl ions and hydrogen oxides which, on combustion with the atmosphere, cause the fuel to propagate ignition evenly through the entire combustion process while substantially eliminating elements that would otherwise form said byproducts.

2. A method as claimed in claim 1 in which said platinum surface is provided by a cylinder housing having platinum-surfaced inner wall portions, and the zinc surface is provided by a zinc element positioned within and movable relative to said cylinder housing, said zinc element being shaped to come into intimate contact with said inner wall portions of said cylinder housing, said cylinder housing being perforated to permit the fuel to flow therethrough and to contact said inner wall portions and said zinc element.

3. A method as claimed in claim 2 in which a portion of said cylinder housing has a rhodium surface electrolytically reacting with said zinc element.

4. A method as claimed in claim 3 in which said cylinder housing has two of said rhodium-surfaced portions respectively at opposite ends thereof.

5. A method as claimed in claim 1 in which the relative surface movement aids the flow of fuel.

6. A method of improving the evenness of progression and degree of completion of combustion of oxygenated hydrocarbon fuel that leads to the substantial elimination of noxious by-products, comprising immersing within the fuel prior to combustion an electrolytic cell comprising juxtaposed zinc and rhodium electrode surfaces to generate electropotentials; flowing the fuel along said surfaces; during the flowing, relatively moving the zinc surface and the rhodium surface to provide for continual contacting with the fuel to continually generate electropotentials and catalytically convert the oxygen in the fuel to hydroxyl ions and hydrogen oxides which, on combustion with the atmosphere, cause the fuel to propagate ignition evenly and without excessive temperature peaks through the entire combustion process to effect control of emissions, with particular benefit to a decrease in the production of oxides of nitrogen.

7. A method as claimed in claim 6 in which the fuel and surfaces are moved relatively to insure uniformity of effect throughout the fuel in anticipation of the combustion process.

8. An electrolytic-catalytic cell for hydrocarbon fuels having, in combination, a perforated cathodic housing comprising inner and outer platinum-surfaces and containing therewithin a negative potential anodic element, the anodic element being movable within the housing inner surface with sufficient clearance provided to permit the continual passage of fuel along the housing inner surface and the anodic element.

9. An electrolytic-catalytic cell as claimed in claim 8 in which the anodic element is substantially pure zinc.

10. An electrolytic-catalytic cell as claimed in claim 8 in which the outer housing surface is provided with means for insulating the outer housing surface from a fuel container in which the housing is immersed.

11. An electrolytic-catalytic cell as claimed in claim 8 in which a part of the housing is interiorly surfaced with one of rhodium or rhenium.

12. An electrolytic-catalytic cell as claimed in claim 8 in which the housing is cylindrical and is provided with closing end caps.

13. An electrolytic-catalytic cell as claimed in claim 12 in which the end caps have surfaces consisting of one of rhodium and rhenium.

14. An electrolytic-catalytic cell as claimed in claim 8 in which the anodic element and the housing electrolytically and directly contact one another during operation of the cell within the fuel.

15. An electrolytic-catalytic cell as claimed in claim 8 in which the housing and anodic element are of similar shape but with the anodic element of outer dimensions slightly less than corresponding inner dimensions of the housing.

16. An electrolytic-catalytic cell as claimed in claim 15 in which said shape is cylindrical.

17. An electrolytic-catalytic cell as claimed in claim 8 in which said anodic element comprises pellets of zinc packed within the said housing.

18. An electrolytic catalytic cell as claimed in claim 8 in which moving reciprocation of the anodic element within the housing aids in circulating fuel through the cell.

19. A method of improving the progression and totality of combustion of oxygenated hydrocarbon fuels that leads to the substantial elimination of noxious emission by-products, comprising supplying sufficient hydroxyl ions well-distributed throughout the fuel to propagate combustion evenly through the entire combustion process, thereby substantially eliminating elements that would otherwise form said by-products.

20. A method as claimed in claim 19 in which the hydroxyl ions are evenly distributed in the fuel by entrainment prior to combustion.

21. A method as claimed in claim 20 in which said entraining is effected by continual electropotential-metal catalytic action.

22. A method of improving the progression and totality of combustion of oxygenated hydrocarbon fuel that leads to the substantial elimination of noxious emission by-products, comprising immersing within the fuel prior to combustion an electrolytic cell comprising juxtaposed anodic and cathodic electromotive metal electrode surfaces for creating electropotentials; flowing the fuel along said surfaces to provide for continual contacting of said surfaces to continually generate electropotentials and catalytically convert the oxygen in the fuel to hydroxyl ions and hydrogen oxides which, on combustion with the atmosphere, cause the fuel to propagate ignition evenly through the entire combustion process while substantially eliminating that would otherwise form said by-products.

23. A method as claimed in claim 22 in which said cathodic and anodic surfaces are of platinum and zinc, respectively.

24. A method as claimed in claim 23 in which there is at least one other cathodic surface consisting of one of rhodium and rhenium.

25. A method as claimed in claim 23 in which said noxious by-products include carbon monoxide, nitrogen oxides and sulfur oxides which are prevented from forming in the combustion process.

26. A method as claimed in claim 22 in which the cathodic surface is of a platinum-family metal.

27. A method as claimed in claim 26 in which the anodic surface is of zinc.

* * * * *